US011976373B2

(12) United States Patent
Weinelt et al.

(10) Patent No.: US 11,976,373 B2
(45) Date of Patent: May 7, 2024

(54) METHOD FOR ELECTROCHEMICALLY PRODUCING ALKANE DICARBOXYLIC ACIDS BY MEANS OF A RING-OPENING OXIDATION USING A DOPED Ni(O)OH FOAM ELECTRODE

(71) Applicant: Evonik Operations GmbH, Essen (DE)

(72) Inventors: Frank Weinelt, Billerbeck (DE); Franz-Erich Baumann, Duelmen (DE); Siegfried R. Waldvogel, Gau-Algesheim (DE); Anna-Lisa Rauen, Mainz (DE)

(73) Assignee: Evonik Operations GmbH, Essen (DE)

( * ) Notice: Subject to any disclaimer, the term of this patent is extended or adjusted under 35 U.S.C. 154(b) by 0 days.

(21) Appl. No.: 18/001,079

(22) PCT Filed: May 26, 2021

(86) PCT No.: PCT/EP2021/064057
§ 371 (c)(1),
(2) Date: Dec. 8, 2022

(87) PCT Pub. No.: WO2021/249775
PCT Pub. Date: Dec. 16, 2021

(65) Prior Publication Data

US 2023/0212762 A1 Jul. 6, 2023

(30) Foreign Application Priority Data

Jun. 10, 2020 (EP) ..... 20179245

(51) Int. Cl.
*C07C 51/16* (2006.01)
*C07C 51/31* (2006.01)
(Continued)

(52) U.S. Cl.
CPC ..... *C25B 3/23* (2021.01); *C25B 3/07* (2021.01); *C25B 9/15* (2021.01); *C25B 11/031* (2021.01); *C25B 11/047* (2021.01)

(58) Field of Classification Search
CPC .. C25B 3/07; C25B 3/23; C07C 51/16; C07C 51/31
(Continued)

(56) References Cited

U.S. PATENT DOCUMENTS 6,149,836 A 11/2000 Mumcu et al.
7,033,989 B2 4/2006 Keck et al.
(Continued)

FOREIGN PATENT DOCUMENTS

CN 109837555 6/2019
CN 111229267 6/2020
EP 2 907 898 8/2015

OTHER PUBLICATIONS

Yi et al., "Electrocatalytic Oxidation of Cyclohexanol on a Nickel Oxyhydroxide Modified Nickel Electrode in Alkaline Solutions," Catalysis Communications (Jul. 1, 2007), vol. 8, No. 7, pp. 1017-1022. (Year: 2007).*
(Continued)

*Primary Examiner* — Edna Wong
(74) *Attorney, Agent, or Firm* — Grüneberg and Myers PLLC

(57) ABSTRACT

A method for the electrochemical preparation of alkanedicarboxylic acids involves a ring-opening oxidation with a doped Ni(O)OH foam electrode in an aqueous alkaline solution.

20 Claims, 2 Drawing Sheets

(51) Int. Cl.

| | |
|---|---|
| ***C25B 3/07*** | (2021.01) |
| ***C25B 3/23*** | (2021.01) |
| ***C25B 9/15*** | (2021.01) |
| ***C25B 11/031*** | (2021.01) |
| ***C25B 11/047*** | (2021.01) |

(58) Field of Classification Search
USPC ..... 205/440; 562/509
See application file for complete search history.

(56) References Cited

U.S. PATENT DOCUMENTS

| | | | | |
|---|---|---|---|---|
| 8,604,227 | B2 | 12/2013 | Petrat et al. | |
| 9,670,585 | B2 | 6/2017 | Dyballa et al. | |
| 9,879,353 | B2 | 1/2018 | Dyballa et al. | |
| 2003/0162952 | A1 | 8/2003 | Keck et al. | |
| 2013/0006005 | A1 | 1/2013 | Petrat et al. | |
| 2015/0225861 | A1* | 8/2015 | Hoppe | C25B 11/077 205/412 |
| 2016/0010225 | A1 | 1/2016 | Dyballa et al. | |
| 2016/0017505 | A1 | 1/2016 | Dyballa et al. | |
| 2019/0177478 | A1 | 6/2019 | Micoine et al. | |
| 2022/0227932 | A1 | 7/2022 | Weinelt et al. | |
| 2022/0246252 | A1 | 8/2022 | Stache et al. | |

OTHER PUBLICATIONS

Sun et al., "Efficient and Selective Ethane-to-Ethylene Conversion Assisted by a Mixed Proton and Electron Conducting Membrane," Journal of Membrane Science (Apr. 1, 2020), vol. 599, 117840, pp. 1-8. (Year: 2020).*

Lyalin et al., "Oxidation of Organic Compounds on NiOOH Electrode," Russian Journal of Electrochemistry (Nov. 2010), vol. 46, pp. 1199-1214. (Year: 2010).*

Hans-Jürgen Schäfer, "Oxidation of Organic Compounds at the Nickel Hydroxide Electrode", Topics in Current Chemistry, vol. 142, 1987, pp. 101-129.

International Search Report dated Jul. 13, 2021, in PCT/EP2021/064057, with English translation, 7 pages.

International Preliminary Report on Patentability dated Mar. 15, 2022, in PCT/EP2021/064057, with English translation, 17 pages.

Johannes Kaulen, "Oxidation of diols and secondary alcohols at the nickel hydroxide electrode. Application to the selective oxidation of hydroxysteroids", Dissertation, University of Münster 1981, 1981, 53 pages.

Kaulen et al., "Oxidation of alcohols by electrochemically regenerated nickel oxide hydroxide selective oxidation of hydroxysteroids", Tetrahedron, vol. 38, No. 22, 1982, pp. 3299-3308.

Lyalin et al., "Electrosynthesis of adipic acid by undivided cell electrolysis", Russian Chemical Bulletin, International Edition, vol. 53, No. 3, Mar. 2004, pp. 688-692.

Lyalin et al., "Oxidation of Organic Compounds on NiOOH Electrode", Russian Journal of Electrochemistry, vol. 46, No. 11, 2010, pp. 1199-1214.

Prof. Kazmaier, "Stereochemie", Saarland University, http://www.unisaarland.de/fak8/kazmaier/PDF_files/vorlesungen/Stereochemie%20Strassb%20Vorlage.pdf., retrieved Nov. 15, 2022, pp. 1-20.

Schmitt et al., "Highly selective generation of vanillin by anodic degradation of lignin: a combined approach of electrochemistry and product isolation by adsorption", Journal of Organic Chemistry, vol. 11, 2015, pp. 473-480.

Written Opinion dated Jul. 13, 2021, in PCT/EP2021/064057, with English translation, 11 pages.

U.S. Appl. No. 16/216,143, filed Dec. 11, 2018, 2019/0177478, Micoine et al.

U.S. Appl. No. 17/611,251, filed Nov. 15, 2021, 2022/0227932, Weinelt et al.

U.S. Appl. No. 17/642,562, filed Mar. 11, 2022, 2022/0246252, Stache et al.

* cited by examiner

METHOD FOR ELECTROCHEMICALLY PRODUCING ALKANE DICARBOXYLIC ACIDS BY MEANS OF A RING-OPENING OXIDATION USING A DOPED Ni(O)OH FOAM ELECTRODE

CROSS-REFERENCE TO RELATED APPLICATIONS

This application is the National Stage entry under § 371 of International Application No. PCT/EP2021/064057, filed on May 26, 2021, and which claims the benefit of priority to European Application No, 20179245.4, filed on Jun. 10, 2020. The content of each of these applications is hereby incorporated by reference in its entirety.

BACKGROUND OF THE INVENTION

Field of the Invention

The invention relates to a method for the electrochemical preparation of alkanedicarboxylic acids by ring-opening oxidation by means of a doped Ni(O)OH foam electrode in aqueous alkaline solution.

Description of Related Art

Johannes Kaulen and Hans-Jürgen Schäfer (Tetrahedron 1982, 38(22), 3299-3308) disclose the conversion of unsubstituted cyclohexanol to unsubstituted adipic acid at a Ni(O)OH electrode. This electrode was designed as a plate electrode. The products were in no case actually isolated. The same results were also obtained by Hans-Jürgen Schäfer (Topics in Current Chemistry, 1987, 142, 101-129).

Johannes Kaulen ("Oxidation of dials and secondary alcohols at the nickel hydroxide electrode. Application to the selective oxidation of hydroxysteroids", Dissertation, University of Münster 1981) discloses investigations of the electrochemical oxidation of cyclohexanol. He achieved notable conversions at nickel hydroxide electrodes at relatively high temperatures, in part with ring-cleaving formation of adipic acid.

B. V. Lyalin and V. A. Petrosyan (Russian Journal of Electrochemistry, 2010, 46(11), 1199-1214) disclose the preparation of unsubstituted adipic acid and the oxidation of carbohydrates.

In "Electrosynthesis of adipic acid by undivided cell electrolysis" (Russian Chemical Bulletin, International Edition, Vol, 53 No. 3 pp. 688-692, March, 2004), the same authors disclose the ring-cleaving electrochemical oxidation of cyclohexanol to adipic acid at nickel hydroxide electrodes. This paper reports a maximum yield of adipic acid of 46.7% at a simultaneous current yield of 11.5%. By-products in the reaction are succinic acid and glutaric acid formed in a yield of 6.3% and 11.5% respectively. These components are formed by oxidative elimination of $CH_2$ groups from the C6 core structure of cyclohexanol.

In one embodiment variant, EP 2907898 A1 (US 2015/0225861 A1) discloses the use of nickel foam at reaction temperatures of 80° C. for the oxidative ring cleavage of 3,3,5-trimethylcyclohexanol. The reaction was carried out in highly diluted solution with low yields.

Schmitt et al. (Beilstein J. Org. Chem., 2015, 11, 473-480) disclose the cleavage of lignin in diverse oxo-substituted aromatics using various electrodes. The oxidation to the corresponding acids did not occur.

SUMMARY OF THE INVENTION

The present invention relates to a method for the electrochemical preparation of alkanedicarboxylic acids by ring-opening oxidation by means of an Ni(O)OH foam electrode doped with elements of main group 5 and/or 6 in aqueous alkaline solution.

DETAILED DESCRIPTION OF THE INVENTION

Figure 1:
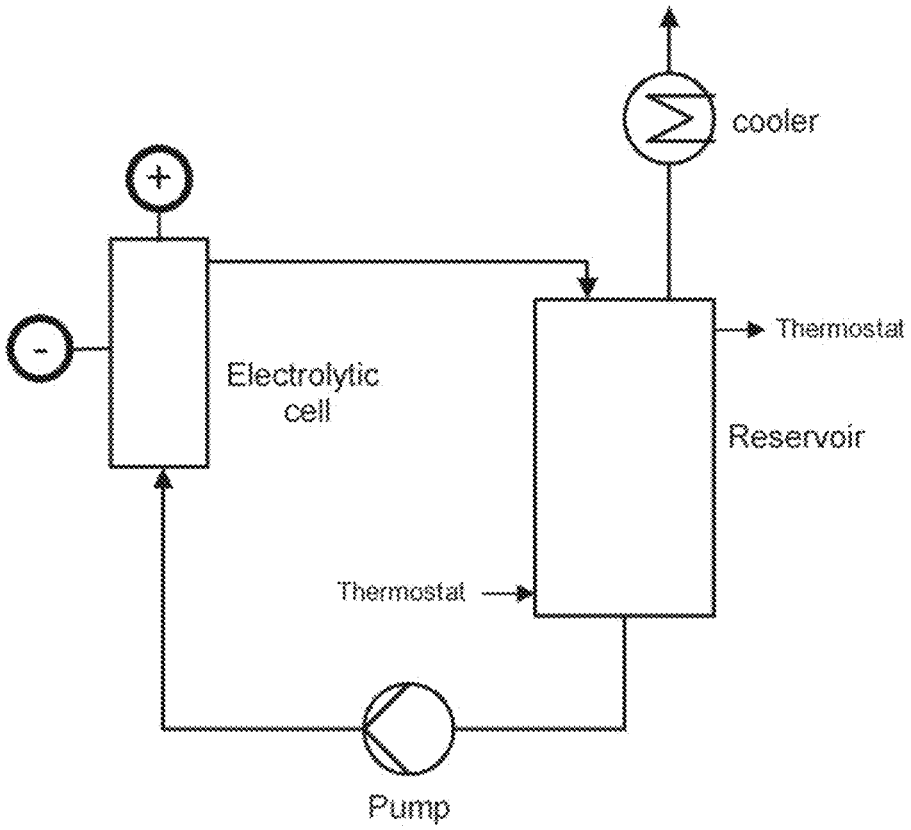
FIG. 1 shows the schematic design of a continuous flow reaction cell.

The method according to the invention is described hereinafter by way of example, without any intention of limiting the invention to these illustrative embodiments. Where ranges, general formulae, or classes of compound are stated below, these are intended to comprise not only the corresponding ranges or groups of is compounds explicitly mentioned, but also all subranges and subgroups of compounds that can be obtained by extracting individual values (ranges) or compounds. Where documents are cited in the context of the present description, the entire content thereof is intended to be part of the disclosure content of the present invention, Where percentage data are provided hereinafter, these are data in % by weight unless otherwise stated. In the case of compositions, % values are based on the total composition unless otherwise stated. Where average values are provided hereinafter, these are averages by mass (averages by weight) unless otherwise stated. Where measured values are given hereinafter, these measured values were determined at a pressure of 101 325 Pa and at a temperature of 25° C. unless otherwise stated.

An advantage of this method compared to chemical oxidation methods is the avoidance of using chemical oxidizing agents such as nitric acid.

A further advantage is the high yield of the method according to the invention.

Implementation in a flow-through cell is technically simpler and more robust than all designs of the prior art. All mechanically laborious processes, such as stirring processes, can be omitted.

The present invention thus introduces for the first time the possibility of developing an industrially relevant continuous process for obtaining alkanedicarboxylic acids without the use of aggressive chemicals and still in high yields.

In the method according to the invention, preference is given to preparing alkanedicarboxylic acids (DC) according to scheme (I)

Scheme (I)

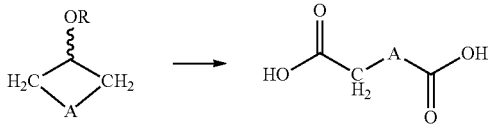

where ∿∿∿ represents a single or double bond, R accordingly being present or not, where R is hydrogen or an acyl radical, wherein the acyl radical is the radical of an aliphatic monocarboxylic acid having 2 to 8 carbon atoms, preferably 2 to 5 carbon atoms, particularly preferably is an acetyl, and where A is a hydrocarbon having 4 to 30 carbon atoms, in which all ring carbon atoms of A in the cyclic reactant of scheme (I) bear at least one hydrogen substituent, A comprising at least 2 ring carbon atoms, more preferably 3 to 9 ring carbon atoms.

In the case that ∿∿ is a single bond and R is hydrogen (cycloalkanols), the method according to the invention is preferably carried out according to scheme (II).

Scheme (II)

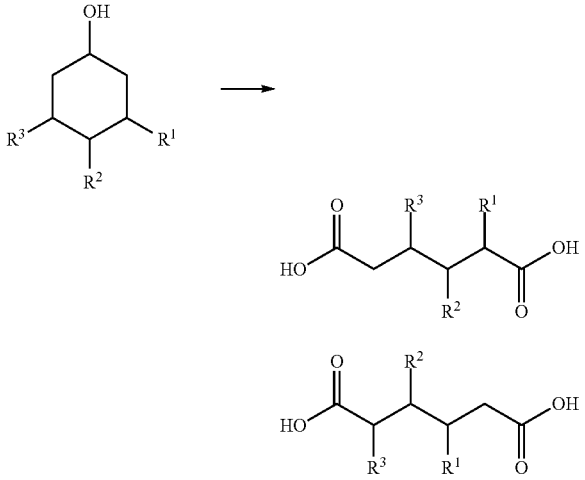

$R^1$, $R^2$, $R^3$ may be the same or different, hydrogen or alkyl radicals having 1 to 8 carbon atoms, preferably 1 to 5 carbon atoms, linear or branched, in which at least one of the radicals $R^1$, $R^2$, $R^3$ is an alkyl radical.

More preferably, only one of the radicals $R^1$, $R^2$, $R^3$ is an alkyl radical having 1 to 4 carbon atoms. Particularly preferably, the radicals $R^1$ and $R^3$ are hydrogen and $R^2$ is an alkyl radical having 1 to 4 carbon atoms.

In the case that ∿∿ is a single bond and R is an acyl radical (acylcycloalkanols), the method according to the invention is preferably carried out according to scheme (III).

Scheme (III)

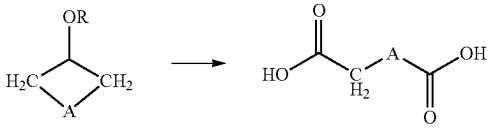

where the acyl radical is an acetyl, and

A is a hydrocarbon having 4 to 9 carbon atoms, in which all ring carbon atoms of A in the cyclic reactant of scheme (III) bear at least one hydrogen substituent, A comprising at least 3 ring carbon atoms (acylhexanols), more preferably 3 to 9 ring carbon atoms.

In the case that ∿∿ is a double bond and R is not present (cycloalkanones), the method according to the invention is preferably carried out according to scheme (IV).

Scheme (IV)

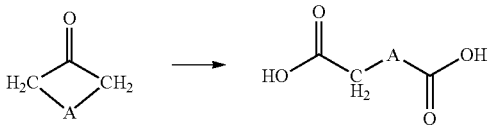

where A is a hydrocarbon having 4 to 9 carbon atoms, in which all ring carbon atoms of A in the cyclic reactant of scheme (IV) bear at least one hydrogen substituent, A comprising at least 2 ring carbon atoms, more preferably 3 to 9 ring carbon atoms.

The method according to the invention is preferably carried out according to at least one of the schemes (II), (III) or (IV).

In all cases where molecules/molecule fragments have one or more stereocentres or can be differentiated into isomers on account of symmetries or can be differentiated into isomers on account of other effects, for example restricted rotation, all possible isomers are covered by the present invention.

Isomers are known to those skilled in the art; in particular, reference is made to the definitions of Prof. Kazmaier of Saarland University, for example http://www.uni-saarland.de/fak8/kazmaier/PDF_Files/vorlesungen/Stereochemie %20Strassb %20Vorlage.pdf.

The Ni(O)OH foam electrode preferably has a doping selected from phosphorus, arsenic, selenium and sulfur, more preferably from phosphorus.

The figures for the doping content refer to the elemental state of the doping, based on the mass of metal of the electrode.

The Ni(O)OH foam electrode preferably comprises 2 to 10% by weight, preferably 3 to 9% by weight and more preferably 4 to 9% by weight doping.

The Ni(O)OH foam electrode preferably comprises 2 to 10% by weight phosphorus, preferably 3 to 9% by weight and more preferably 4 to 9% by weight, the phosphorus here being considered as an element and based on the metal mass of the electrode.

The phosphorus doping content is preferably determined in accordance with DIN EN ISO 5427, Appendix D.1.

The Ni(O)OH foam electrode preferably has a thickness of two or more millimetres, more preferably more than 3 mm, even more preferably more than 5 mm and especially preferably equal to or thicker than 6 mm.

The Ni(O)OH foam electrode comprises nickel as metal preferably to an extent of at least 90% by weight, more preferably at least 95, 98, 99% by weight, even more preferably at least 99.9, especially preferably at least 99.99% by weight.

The Ni(O)OH foam electrode may comprise further metals besides nickel. Further metals are preferably Co, Fe and Cu.

The content of other metals in the Ni(O)OH foam electrode is preferably equal to or less than 10% by weight, more preferably 5% by weight, even more preferably 2% by weight, especially preferably less than or equal to 1% by weight, based on the total metal content.

The Ni(O)OH foam electrode preferably comprises at most 5% by weight, preferably 2% by weight, more preferably 1% by weight and particularly preferably 0.5% by weight and especially preferably at most 0.1% by weight iron or iron compounds, wherein the content figures are based on the element with respect to the total metal content.

The Ni(O)OH foam electrode preferably comprises each at most 1% by weight, preferably each 0.1% by weight and more preferably each at most 0.01% by weight of V, Wo and Mo; these metals are subject to corrosion in alkaline aqueous medium, which can have an unfavourable effect on the method according to the invention.

Useful cathode materials are in principle any metals inert to the reaction medium. Preferably used in accordance with the invention is stainless steel, platinum or nickel or a mixture.

The method according to the invention is carried out in aqueous alkaline solution. Preferred cosolvents can be alcohols or DMSO. Preference is given to the presence of up to 30% by volume of a cosolvent, more preferably 1 to 20% by volume, based on the sum total of the solvents, the solvent more preferably consisting of water.

Suitable alkaline additives include in principle all known inorganic bases. In the method according to the invention, preference is given to alkali metal hydroxides, such as LiOH, NaOH, KOH, and soluble alkaline earth metal hydroxides. In accordance with the invention, it is particularly preferable to use sodium hydroxide. Preferably, no other anions of bases are present.

The concentration of the alkaline additive is preferably 0.5 to 2 mol/l, based on the aqueous alkaline solution, more preferably 0.8 to 1.5 mol/l and particularly preferably 1 mol/l with a possible deviation of up to 10%, preferably a deviation of up to 5% in the molarity.

In the method according to the invention, the concentration of the reactants according to scheme (I) is preferably 0.06 to 0.5 mol/l, more preferably 0.08 to 0.3 and particularly preferably 0.09 to 0.11 mol/l.

The total current which results in the conversion according to the invention according to scheme (II) and (III) is, according to theory, 8 F. Preference is given to using 8 to 10 F, more preferably 8.5 to 9 F.

The unit F stands for Faraday which is defined as the product of Avogadro's constant and the elementary charge of an electron: $F=N_A*e$.

For the conversion according to scheme (IV), 6 F are theoretically required. Preference is given to using 6 to 8 F, more preferably 6.5 to 7 F.

The method according to the invention is preferably carried out at a current density of 2 to 10 mA/cm$^2$, more preferably 2.5 to 7.5 mA/cm$^2$ and especially preferably 3.3 to 6 mA/cm$^2$. The area refers to the geometric area without consideration of the inner surface area of the foam. These figures for the current density refer to the greatest area of one of the sides and are therefore independent of the direction of flow in the case of a flow-through cell.

The method according to the invention can be carried out discontinuously, for example in a batch electrolytic cell or continuously in a flow-through electrolytic cell, preferably in a continuous flow electrolytic cell.

The method according to the invention is preferably carried out at temperatures of 20-70° C., preferably 30-60° C., more preferably 35-50° C.

The method according to the invention is also preferably carried out using a doped Ni(O)OH foam electrode, wherein the doping is selected from phosphorus, arsenic, selenium and sulfur, wherein the concentration of alkali is 0.8 to 1.5 mol/l and the concentration of reactant according to scheme (I) is 0.08 to 0.3 mol/l.

The method according to the invention is also preferably carried out using a Ni(O)OH foam electrode doped with phosphorus, in which the concentration of alkali is 0.8 to 1.5 mol/l and the current density is from 2 to 10 mA/cm$^2$.

The method according to the invention is even more preferably carried out using a Ni(O)OH foam electrode doped with phosphorus according to scheme (II)

Scheme (II)

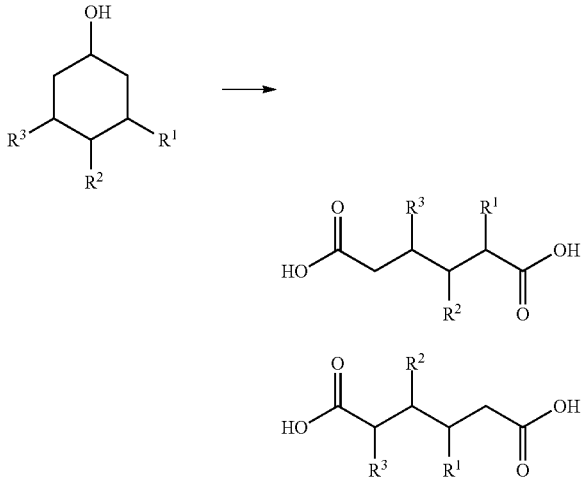

where $R^1$, $R^2$, $R^3$ are the same or different, hydrogen or alkyl radicals having 1 to 8 carbon atoms, preferably 1 to 5 carbon atoms, linear or branched, in which at least one of the radicals $R^1$, $R^2$, $R^3$ is an alkyl radical, wherein more preferably only one of the radicals $R^1$, $R^2$, $R^3$ is an alkyl radical having 1 to 4 carbon atoms and particularly preferably the radicals $R^1$ and $R^3$ are hydrogen and $R^2$ is an alkyl radical having 1 to 4 carbon atoms.

The method according to the invention is even more preferably carried out using a Ni(O)OH foam electrode doped with phosphorus according to scheme (IV)

Scheme (IV)

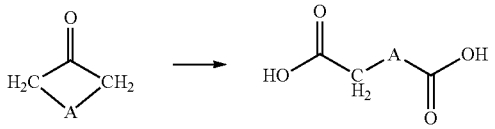

where A is a hydrocarbon having 4 to 9 carbon atoms, in which all ring carbon atoms of A in the cyclic reactant of scheme (IV) bear at least one hydrogen substituent, A preferably comprising at least 2 ring carbon atoms, more preferably 3 to 9 ring carbon atoms.

The method according to the invention is more preferably carried out using a Ni(O)OH foam electrode doped with phosphorus in a flow-through cell in which the concentration of alkali is 0.8 to 1.5 mol/l and the concentration of reactant according to scheme (I) is 0.08 to 0.3 mol/l.

The method according to the invention is particularly preferably carried out using a Ni(O)OH foam electrode doped with phosphorus in a flow-through cell in which the concentration of alkali is 0.8 to 1.5 mol/l wherein the concentration of reactant according to scheme (I) is 0.08 to 0.3 mol/l and in which the flow rate of the reaction medium in the anode compartment is at least 5 cm/min, preferably at least 8 cm/min, more preferably at least 10 cm/min.

FIG. 1 shows the schematic design of a continuous flow reaction cell.

Figure 2:
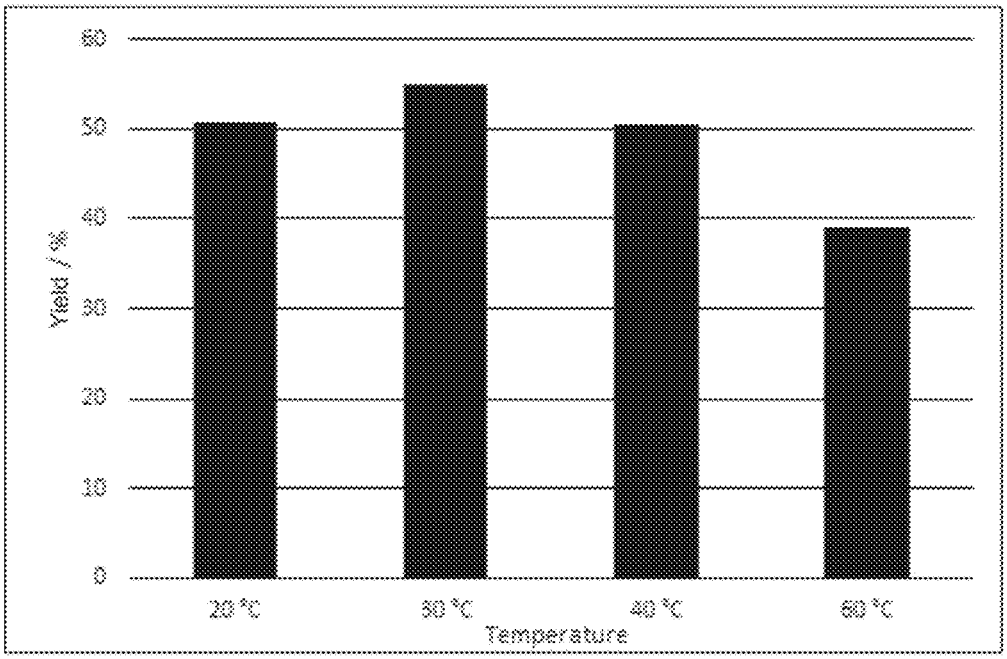
FIG. 2 shows the temperature dependency of the yield of the reaction in accordance with Table 1, entry 1, for the doped anode in the batch experiment.

FIG. 2 shows the temperature dependency of the yield of the reaction in accordance with Table 1, entry 1, for the doped anode in the batch experiment.

Electrodes

All anodes used had the dimensions of length 60 mm, width 20 and thickness 6 mm. In the batch method, however, only half the area (length 30 mm) was immersed for carrying out the method according to the invention. The cathodes have the identical surface dimensions as the anodes, but composed as sheet metal. The thickness plays no essential role, in particular in the flow-through method only one surface is exposed to the reaction medium.

The nickel foam electrodes had a thickness of 0.35 to 0.44 g/cm$^3$. This corresponds to a porosity of 95 to 96%.

The phosphorus-doped electrodes were obtained from Aqua Titan, Dortmund.

The Ni(O)OH layer of the anodes was formed in 280 ml of a solution of 0.1 mol/l $NiSO_4*6H_2O$, 0.1 mol/l $NaOAc*3H_2O$, 0.005 mol/l NaOH in distilled water. The electrodes were fully immersed and coated at room temperature with pole changes (10 s) at 150 Coulomb and 10 mA/cm$^2$. After reaction was complete, the electrodes were rinsed off and then dried.

Ring-Opening Electrooxidation a) Batch Method

For the electrooxidation, the reaction cell was filled with water and the sodium hydroxide dissolved therein (1 mol/l) and the substance to be oxidized (reactant according to scheme (I)) (25 ml). The concentration of reactant was 0.1 mol/l. Then, the stirred solution was temperature-controlled. The electrooxidation was carried out under galvanostatic conditions. The anode used in the experiments according to the invention was the doped Ni(O)OH foam electrode prepared above, in the non-inventive experiments identically constructed electrodes which had not been doped with phosphorus were in principle used, and stainless steel plate electrodes served as cathodes.

After completion of the reaction, the solution was quantitatively withdrawn (with post-rinsing with demineralized water and dichloromethane (20 ml each)) and extracted with dichloromethane (ratio by volume: water to organic solvent about 2:1). The remaining aqueous phase was adjusted to pH 1 with 50% sulfuric acid and extracted four times with diethyl ether (ratio by volume: water to organic solvent about 2:1). The organic phases (dichloromethane/diethylether) were both separately dried over sodium sulfate and the solvents were then removed on a rotary evaporator.

b) Flow-Through Method

The doped Ni(O)OH foam electrode prepared above was incorporated in a multilayered Teflon block in such a way that flow-through was complete, the inlet area size was 6 mm*20 mm and the direction of flow therefore longitudinal to the electrode. The cathode was attached separately through a slotted plate at a gap of less than one millimetre. The chamber was perfused vertically from bottom to top. The pump used was a Ritmo® 05 from Fink Chem+Tec GmbH & Co. KG.

The reaction solutions were used as in the batch method. The processing was carried out as in the batch method.

NMR Spectroscopy $^1$H- and $^{13}$C-NMR spectra were recorded on a multinuclear resonance spectrometer of the AC 300 and AC II 400 type from *Bruker Analytische Messtechnik*, Karlsruhe. $CDCL_3$ was used as solvent. The chemical shifts are specified here in ppm and relate to the proton signal of the deuterated solvent. The signals were then assigned with the aid of H-COSY, H,C-HSQC and H,C-HMBC experiments, wherein the final evaluation of the spectra was carried out using the MestReNova program (version: 7.01-8414).

The yields stated in the tables were determined by integration of the signals in the $^{13}$C-NMR (inverse gated) against trimethoxybenzene standard. The yields are molar-related figures.

TABLE 1

Conversion examples of different alkylcycloalkanols (CH) to alkanedicarboxylic acids (DC)

| Entry | Alkylcycloalkanol (CH) | Alkanedicarboxylic acids (DC) |
|---|---|---|
| 1 | 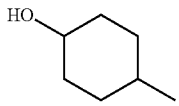 CH1 | 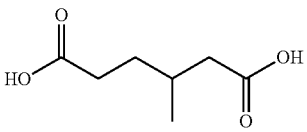 DC1 |
| 2 | 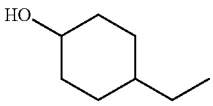 CH2 | 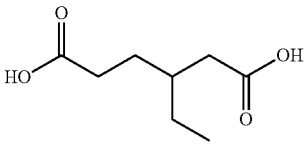 DC2 |

TABLE 1-continued
| Conversion examples of different alkylcycloalkanols (CH) to alkanedicarboxylic acids (DC) | | |
|---|---|---|
| Entry | Alkylcycloalkanol (CH) | Alkanedicarboxylic acids (DC) |
| 3 | 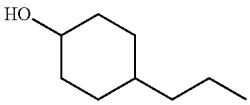 CH3 | 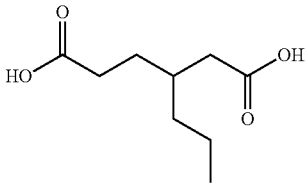 DC3 |
| 4 | 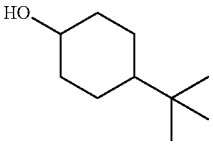 CH4 | 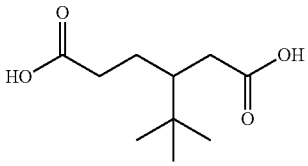 DC4 |
| 5 | 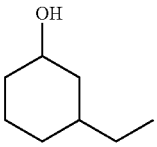 CH5 | 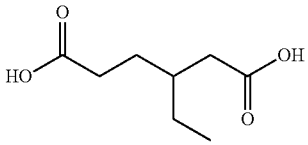 + 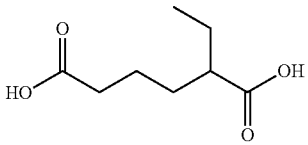 DC5 |
| 6 | 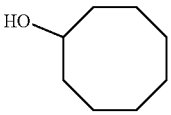 CH6 | 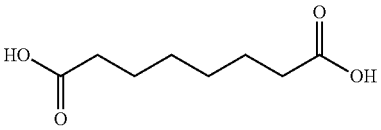 DC6 |
TABLE 2
| Conversion examples of different alkylcycloalkanones (CO) to alkanedicarboxylic acids (DC) | | |
|---|---|---|
| Entry | Alkylcycloalkanones (CO) | Alkanedicarboxylic acids (DC) |
| 7 | 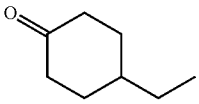 CO1 | 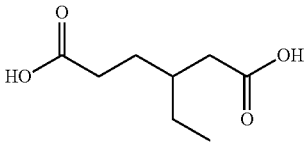 DC2 |

TABLE 2-continued

Conversion examples of different alkylcycloalkanones (CO) to alkanedicarboxylic acids (DC)

| Entry | Alkylcycloalkanones (CO) | Alkanedicarboxylic acids (DC) |
|---|---|---|
| 8 | 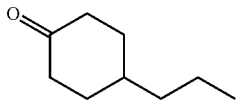 CO2 | 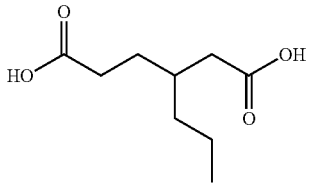 DC3 |
| 9 | 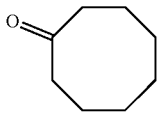 CO3 | 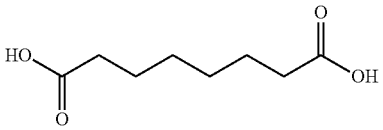 DC6 |

TABLE 3

Effect of phosphorus doping on the yield of diverse alkylcycloalkanols (CH) according to table 1; non-doped anode is non-inventive (batch), doped anode (batch) and flow-through (doped anode) are inventive

| | Non-doped anode | | Doped anode | | Flow- |
|---|---|---|---|---|---|
| Entry | Yield [%] | Temperature; Current density, Amount of charge | Yield [%] | Temperature; Current density, Amount of charge | through Yield [%] |
| 1 | 53 | 20° C.; 5 mA/cm$^{2,}$ 8.5 F. | 63 | 20° C. 2.5 mA/cm$^{2,}$ 8 F. | 63 |
| 2 | 44 | 50° C. 2.5 mA/cm$^{2,}$ 8.5 F. | | | 54 |
| 3 | 36 | 50° C. 2.5 mA/cm$^{2,}$ 8.5 F. | | | 66 |
| 4 | 30 | 50° C. 2.5 mA/cm$^{2,}$ 8.5 F. | 42 | 45° C. 2.5 mA/cm$^{2,}$ 8 F. | 43 |
| 5 | 18 | 50° C. 2.5 mA/cm$^{2,}$ 8.5 F. | 43 | 20° C. 5 mA/cm$^{2,}$ 8 F. | |
| 6 | | | 60 | 45° C. 2.5 mA/cm$^{2,}$ 8 F. | |

TABLE 4

Yield as a function of flow rate; Conversion in the flow-through cell (doped anode) (CH1 to DC1); 60 mA, 8 F., 20° C.

| Entry | Flow rate [ml/min] | DC1 [%] |
|---|---|---|
| 1a | 0.47*10E−3 | 51 |
| 1b | 0.1 | 53 |
| 1c | 1.0 | 56 |
| 1d | 7.5 | 60 |
| 1e | 10.0 | 62 |
| 1f | 12.5 | 64 |

TABLE 5

Dependency of the yield on the alkali (1M = 1 mol/l) and on the solvent (ratio based on volume), conversion in batch mode with doped anode, CH1 to DC1

| Entry | Solvent | Alkali addition | DC 1 [%] |
|---|---|---|---|
| 1-1 | $H_2O$ | 0.1M NaOH | 20 |
| 1-2 | $H_2O$ | 0.5M NaOH | 45 |
| 1-3 | $H_2O$ | 1.0M NaOH | 51 |
| 1-4 | $H_2O$ | 2.0M NaOH | 45 |
| 1-5 | $H_2O$ | 5.0M NaOH | 16 |
| 1-6 | $H_2O$ | 1.0M $K_2CO_3$ | 3 |
| 1-7 | $H_2O$ | 1.0M KOH | 50 |
| 1-8 | $H_2O$/tBuOH (3:7) | 1.0M NaOH | 1 |
| 1-9 | $H_2O$/tBuOH (2:1) | 0.25M NaOH | 26 |
| 1-10 | $H_2O$/tBuOH (1:1) | 0.18M KOH | 7 |
| 1-11 | $H_2O$/PE (1:1) | 1.0M NaOH | 16 |
| 1-12 | $H_2O$/DMSO (1:1) | 1.0M NaOH | 7 |
| 1-13 | $H_2O$/tAmylOH (2:1) | 1.0M NaOH | 27 |

tBuOH = tert butanol,
PE = petroleum ether,
DMSO = dimethyl sulfoxide,
tAmylOH = tert amyl alcohol (2-methyl-2-butanol); 30 mA, 8 F., 20° C.

TABLE 6

Conversion of alkylcycloalkanones (CO) to alkanedicarboxylic acids (CD); reaction in batch mode with doped anode

| | Doped anode | |
|---|---|---|
| Entry | Yield [%] | Temperature; Current density, Amount of charge |
| 7 | 61 | 20° C. 2.5 mA/cm$^{2,}$ 6 F. |
| 8 | 66 | 20° C. 2.5 mA/cm$^{2,}$ 6 F. |
| 9 | 64 | 40° C. 2.5 mA/cm$^{2,}$ 6 F. |

Cyclooctyl acetate was converted in batch mode at the doped anode at 20° C., 5 mA/cm$^2$ and 8 F. to octanediacid (DC6) in 30% yield.

The invention claimed is:

1. A method for the preparation of alkanedicarboxylic acids, the method comprising:

oxidizing a cyclic reactant in a ring-opening oxidation in an aqueous alkaline solution, wherein the oxidation is carried out at an Ni(O)OH foam electrode doped with at least one element of main group 5 and/or 6, according to Scheme (I):

Scheme (I)

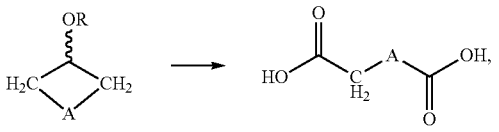

wherein ∿∿∿ represents a single or double bond, R accordingly being present or not, wherein R is hydrogen or an acyl radical, wherein the acyl radical is a radical of an aliphatic monocarboxylic acid having 2 to 8 carbon atoms, and wherein A is a hydrocarbon having 4 to 30 carbon atoms, in which all ring carbon atoms of A in the cyclic reactant of scheme (I) bear at least one hydrogen substituent, and wherein the Ni(O)OH foam electrode comprises 2 to 10% by weight of phosphorus, the phosphorus as an element and based on a metal mass of the Ni(O)OH foam electrode.

2. The method according to claim 1, wherein the Ni(O)OH foam electrode is doped with at least one selected from the group consisting of phosphorus, arsenic, selenium, and sulfur.

3. The method according to claim 1, wherein the Ni(O)OH foam electrode comprises 3 to 9% by weight of the phosphorus, the phosphorus as an element and based on the metal mass of the electrode.

4. The method according to claim 1, wherein the Ni(O)OH foam electrode is two or more millimeters thick.

5. The method according to claim 1, wherein the Ni(O)OH foam electrode comprises nickel as metal.

6. The method according to claim 5, wherein the Ni(O)OH foam electrode comprises the nickel in an amount of at least 80% by weight.

7. The method according to claim 1, wherein the aqueous alkaline solution comprises up to 30% by volume of a cosolvent.

8. The method according to claim 1, wherein an alkaline additive in the aqueous alkaline solution is lithium hydroxide, sodium hydroxide, or potassium hydroxide.

9. The method according to claim 8, wherein a concentration of the alkaline additive is 0.5 to 2 mol/1, based on the aqueous alkaline solution.

10. The method according to claim 8, wherein no further anions of bases are present in the aqueous alkaline solution other than the alkaline additive.

11. The method according to claim 1, wherein in scheme (I) when R=hydrogen and ∿∿∿ is a single bond, a concentration of cycloalkanols is 0.06 to 0.5 mol/1.

12. The method according to claim 11, wherein the concentration of cycloalkanols is 0.09 to 0.11 mol/1.

13. The method according to claim 1, wherein the ring-opening oxidation is according to Scheme (II):

Scheme (II)

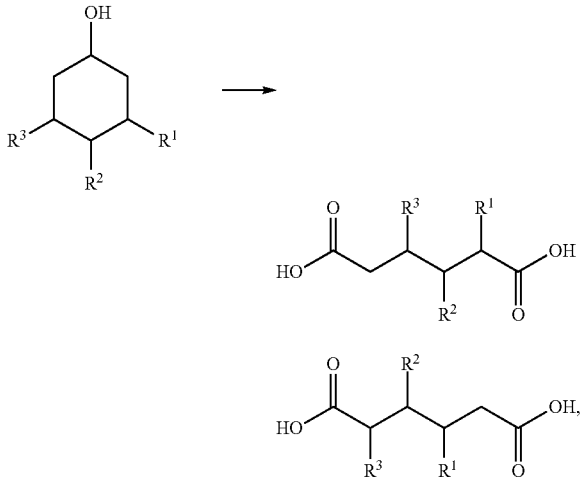

wherein $R^1$, $R^2$, $R^3$ are the same or different, and are hydrogen or alkyl radicals having 1 to 8 carbon atoms, linear or branched, in which at least one of $R^1$, $R^2$, $R^3$ is an alkyl radical.

14. The method according to claim 13, wherein only one of $R^1$, $R^2$, $R^3$ is an alkyl radical having 1 to 4 carbon atoms.

15. The method according to claim 13, wherein $R^1$ and $R^3$ are hydrogen and $R^2$ is an alkyl radical having 1 to 4 carbon atoms.

16. The method according to claim 1, wherein the method is carried out at a current density of 2 to 10 mA/cm$^2$, an area referring to a geometric area without consideration of inner surface area of the foam.

17. The method according to claim 1, wherein the oxidizing comprises electrolysis carried out in a batch electrolytic cell or in a continuous flow electrolytic cell.

18. The method according to claim 17, wherein the oxidizing comprises electrolysis carried out in the continuous flow electrolytic cell.

19. The method according to claim 1, wherein a cathode material is stainless steel, platinum, nickel, or a mixture thereof.

20. The method according to claim 1, wherein the oxidizing comprises electrolysis carried out at a temperature of 20-70° C.

* * * * *